US007403739B2

(12) United States Patent
Hwang

(10) Patent No.: US 7,403,739 B2
(45) Date of Patent: Jul. 22, 2008

(54) IMAGING DEVICE

(75) Inventor: Peter G. Hwang, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 281 days.

(21) Appl. No.: 10/966,247

(22) Filed: Oct. 15, 2004

(65) Prior Publication Data

US 2006/0083566 A1 Apr. 20, 2006

(51) Int. Cl.
*G03G 15/00* (2006.01)

(52) U.S. Cl. ..... 399/391; 399/393

(58) Field of Classification Search ..... 399/391, 399/393, 371, 367, 81, 82, 87, 16
See application file for complete search history.

(56) References Cited

U.S. PATENT DOCUMENTS 3,989,236 A * 11/1976 Komori et al. ..... 271/4.1
4,770,403 A * 9/1988 Katsumata et al. ..... 271/9.07
5,080,343 A * 1/1992 Kushima et al. ..... 271/5
5,102,112 A * 4/1992 Takahashi ..... 271/9.08
5,224,693 A * 7/1993 Taguchi et al. ..... 271/9.11
6,089,772 A * 7/2000 Takemura et al. ..... 400/625
6,135,438 A * 10/2000 Newman et al. ..... 271/9.07
6,361,038 B1 * 3/2002 Tada et al. ..... 271/111
6,688,590 B2 * 2/2004 Billings et al. ..... 271/9.05
6,776,405 B2 * 8/2004 Eskey ..... 271/9.08
7,134,659 B2 * 11/2006 Sato et al. ..... 271/265.01
2002/0195768 A1 * 12/2002 Yamakawa et al. ..... 271/213
2003/0053101 A1 * 3/2003 Matsumoto ..... 358/1.13

FOREIGN PATENT DOCUMENTS

JP 2002-338070 * 11/2002

* cited by examiner

*Primary Examiner*—Anthony H. Nguyen

(57) ABSTRACT

Embodiments of an imaging device are disclosed. In an example embodiment, first and second trays are provided. The second tray is movable. A roller is also provided that is configured to pick media from the first tray and the second tray, depending upon the position of the second tray.

27 Claims, 5 Drawing Sheets

IMAGING DEVICE

BACKGROUND

Adjusting settings for an imaging device often involves the user configuring or changing settings of an associated driver for the imaging device. For example, selecting a particular one of multiple input trays from which to print can involve configuring software driver settings for the device. Moreover selecting or changing a print mode for the device may also involve configuration of the driver for the imaging device. Some users may find configuring of the driver settings difficult, cumbersome, or time consuming.

Some imaging devices with multiple input trays may employ multiple pick rollers. In some configurations, each input tray has an associated pick roller. The provision of multiple pick rollers for an imaging device may be expensive in some applications. Multiple pick rollers can also add to overall product size, adding up to an inch in product height in some cases.

DETAILED DESCRIPTION

Figure 1:
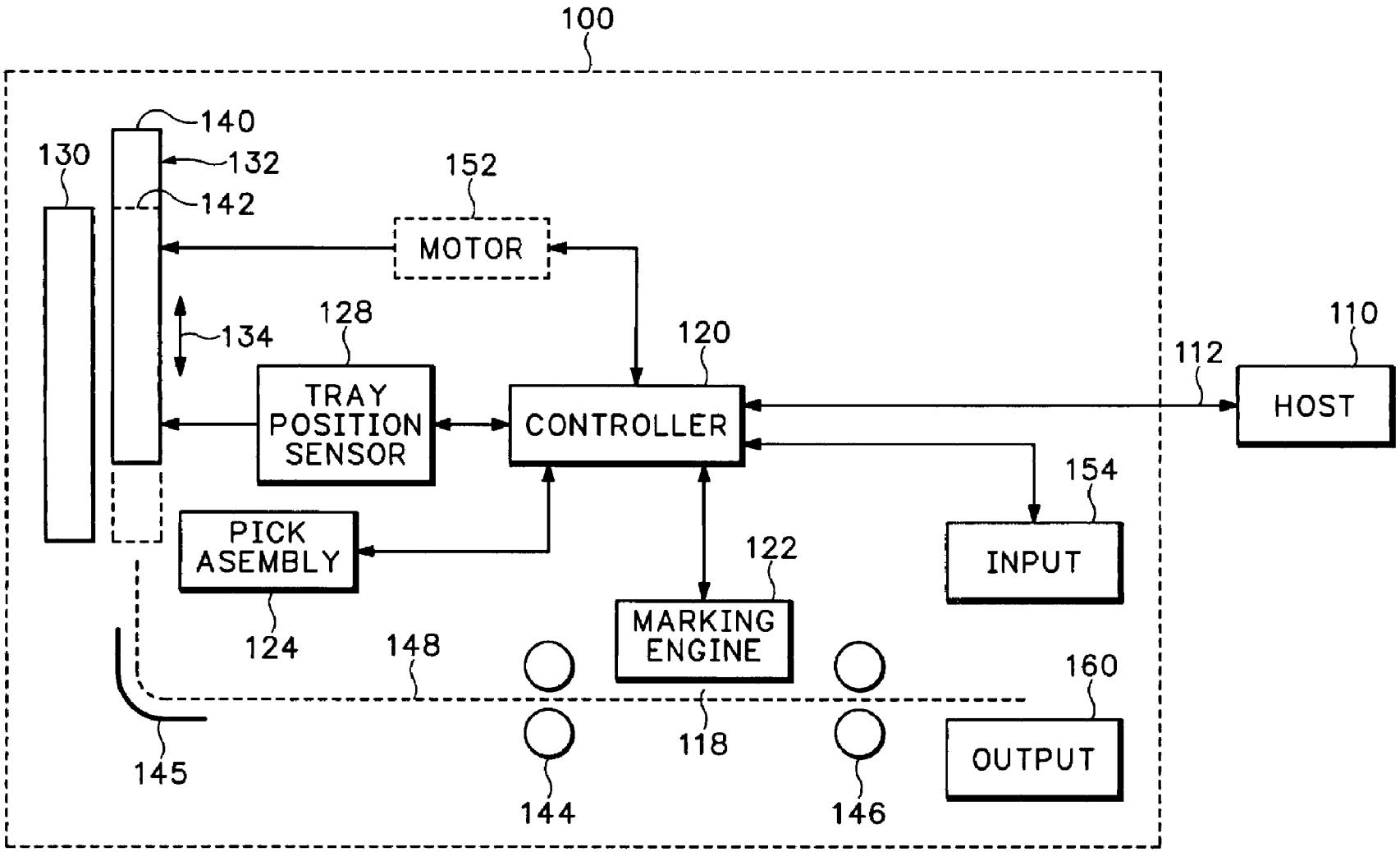
FIG. 1 is a schematic diagram of an imaging device in accordance with an example embodiment.

FIG. 1 is a schematic diagram of an imaging device 100 in accordance with an example embodiment. The imaging device 100 is shown as being in communication with a host 110. The host 110 may comprise, for example, a personal computer. In some embodiments, the host 110 is configured to send print jobs to the imaging device 110 over link 112. The link 112 may comprise a direct link, a network link, a wired link, a wireless link, a combination of these, or any other suitable link. The imaging device 100 could also function as a standalone photo printer or all-in-one copy machine, without a connection to a host 110.

The imaging device 100 is also shown as including a controller 120 configured to communicate with a marking engine 122, a pick assembly 124, tray position sensor 128, and the host 110. The controller 120 may comprise, for example, a processor unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 120 is not limited to any specific combination of hardware circuitry and software, nor to any particular source for the instructions executed by the processing unit. Controller 120 generates control signals for controlling movement of print medium by pick assembly 124 and imaging by the marking engine 122.

The marking engine 122 is configured to print on media at print zone 118 as the media passes from the pick assembly 124 to a media output 116. The marking engine may comprise an inkjet print engine, an electrophotographic print engine, or any other suitable print engine.

The imaging device 100 also includes tray 130 and tray 132 for storing or holding media to be imaged by the marking engine 122. The trays 130, 132 may be oriented in any of a variety of suitable positions and are configured to store media and present media to the pick assembly for advancement to the marking engine 122. The tray 130 is configured to be stationary relative to the pick assembly 124. The tray 132, however, is movable relative to the pick assembly 124. The tray 132 may be movable between positions 140 and 142 (shown in dashed lines) in the directions shown by arrow 134.

In some embodiments, the tray 130 is configured to have a larger capacity than the tray 132. In a particular embodiment, the tray 130 is configured to store a ream (500 sheets) of media. The tray 130 may be configured to hold media of 8.5×11 and A4 sizes. Moreover, the tray 130 may include an optional bias spring (not shown) on a side of the tray 130 to align media therein. The tray 132 may be configured to hold higher quality or more "specialized" media than the tray 130, such as photo paper, brochure paper, or card stock. The tray 132 may be adjusted to hold multiple media sizes ranging from 8.5×11 and A4 to smaller 3×5 cards. In some embodiments, the maximum media size held in tray 132 may be the same size as the maximum media size held in tray 130.

When the tray 132 is in position 140, the pick assembly 124 is adjacent the tray 130 and picks media from the tray 130. Conversely, when the tray 132 is in position 142, the tray 132 is between the tray 130 and the pick assembly 124 such that the pick assembly 124 is adjacent the tray 132 and picks media from the tray 132.

The pick assembly 124 may comprise a pick roller configured to pick media from the tray 132 when the tray 132 is in the position 142 and to begin advancing the picked media along paper path 148. Additional rollers 144, 146 and guide 145 may be provided to further guide, direct, and/or advance the picked media through the print zone 118 to the output 160. The rollers 144, 146 may be driven or passive. The output 160 may comprise an output tray or an output bin. In some embodiments, the paper path 148 is such that a surface of the tray 132 or a cover (not shown in FIG. 1) of the tray 132 may serve as a suitable output.

The tray position sensor 128 detects the position of the tray 132 and communicates an output indicative of the position of the tray 132 to the controller 120. The tray position sensor 128 may comprise, for example, an optical sensor, a switch, or any other suitable sensor. The print mode of the device 100 is set based on the detected position of the tray 132. When the tray 132 is detected to be in position 140, the print mode may be a default print mode. Conversely, when the tray 132 is detected to be in position 142, the print mode may be a higher-quality print mode. In some embodiments, the higher quality print mode may have a slower print speed, a lower throughput speed, a higher resolution, more color, and more swath overlap, than the default print mode. These example characteristics of a higher-quality print mode are merely examples and are neither exhaustive nor limiting.

In some embodiments, the controller 120 selects the print mode for the marking engine 122 based on detected position of the tray 132. In other embodiments, the controller 120 sends data to the host 110 that causes the host 110 to change a print mode setting at the host according to the position of the tray 132. Pursuant to embodiments where the host 110 changes the print mode at the host 110 according to the detected position of the tray 132, the host 110 may change the content of the print job sent from the host 110 to the device 100 based on this print mode.

An optional motor 152 may be provided that operates under control of the controller 120 to move the tray 132 between positions 140, 142 in directions 134. In some embodiments, the controller 120 controls the motor 152 to move the tray 132 between positions 140, 142. In other embodiments, the tray 132 is moved between positions 140, 142 manually, without aid of the motor 152.

FIGS. 2-5 illustrate an imaging device 200 in accordance with another example embodiment. As shown, the imaging device 200 includes trays 230, 232, a pick assembly 224 and a marking engine 222. An optional cover 201 may be slidably mounted on a surface 203 of the tray 232 for covering at least a portion of the tray 230.

In some embodiments, the tray 232 has an optional aperture (not shown) formed in a central region thereof to permit viewing of media in the tray 230 through the aperture.

Figure 2:
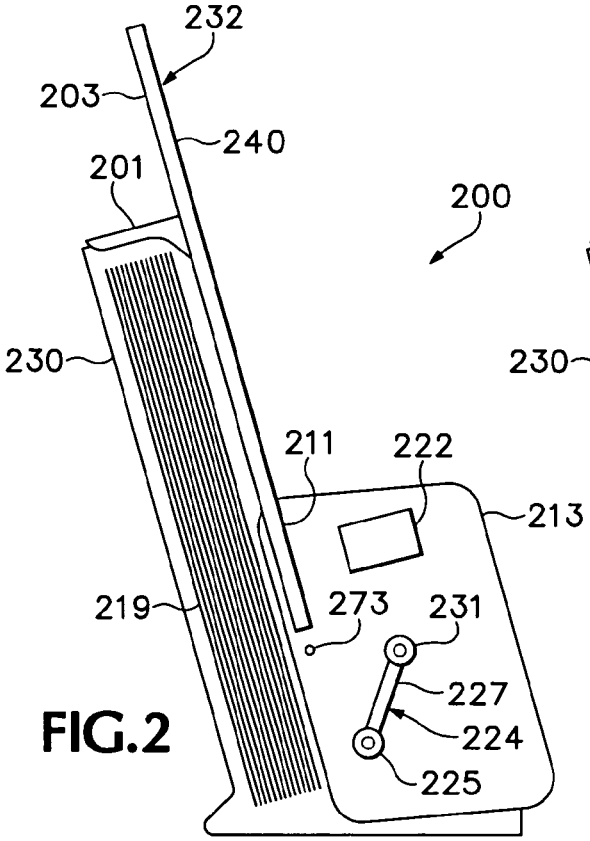
FIG. 2 illustrates an imaging device in accordance with an example embodiment.
Figure 3:
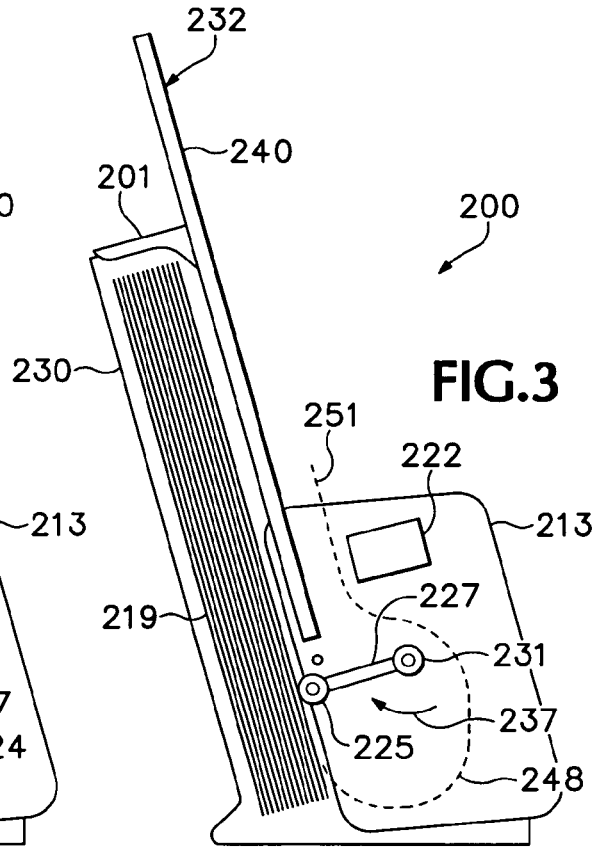
FIG. 3 illustrates the imaging device of FIG. 2 in another position according to another example embodiment.
Figure 4:
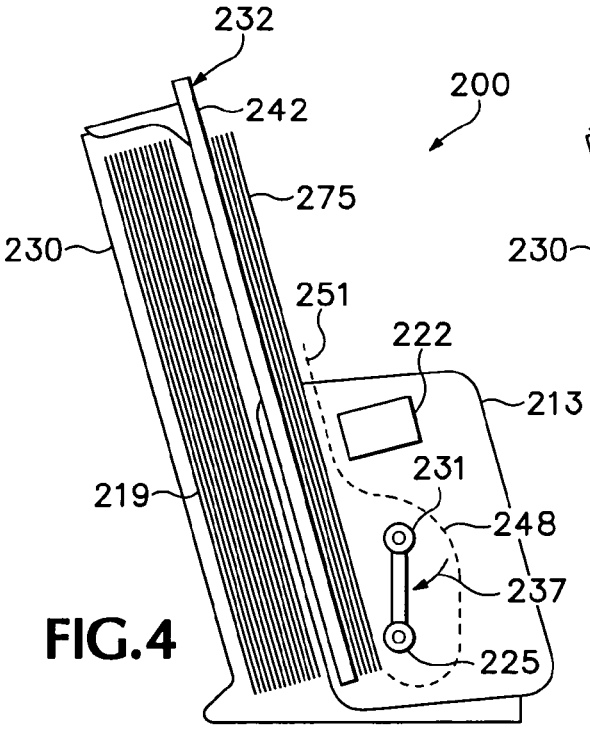
FIG. 4 illustrates the imaging device of FIG. 2 in another position according to another example embodiment.
Figure 5:
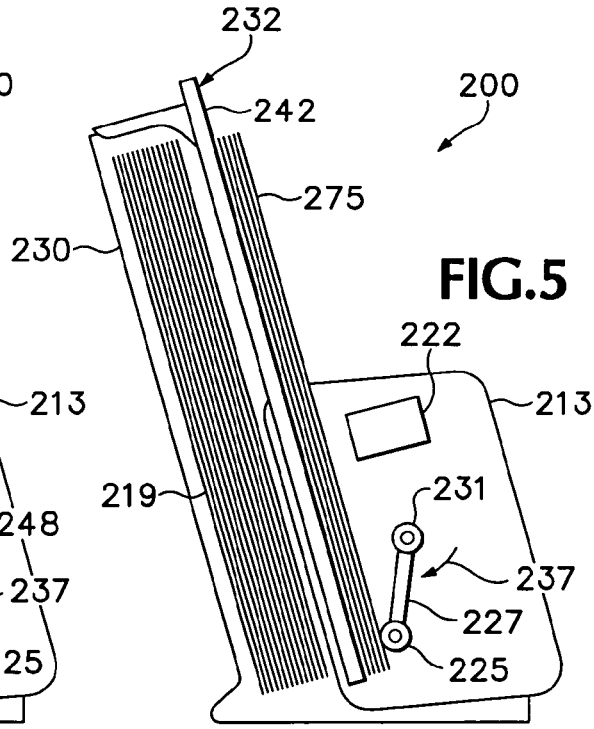
FIG. 5 illustrates the imaging device of FIG. 2 in another position according to another example embodiment.

The tray 232 is slidably disposed in the device 200 relative to the tray 230. FIGS. 2 and 3 illustrate the tray 232 in position 240. FIGS. 4, 5 illustrate the tray 232 in position 242. In some embodiments, the tray 232 is positioned in a slot 211 formed in a housing 213. One or more detents (not shown) may be formed on the housing 213 to position and hold the tray 232 in the position 240. A stack of media sheets 219 is shown as being disposed in the tray 230. In some embodiments, a movable plate (not shown), such as a pressure plate, may be disposed in the tray 230 between the tray 230 and the stack of media sheets 219 to bias the stack of media sheets 219 toward the pick assembly 224.

The pick assembly 224 is shown as including a pick roller 225 disposed at an end of a pick arm 227. The pick arm 227 is rotatably mounted within the housing 213 such that the pick arm 227 is rotatable about an axis of rotation 231. FIG. 2 illustrates the pick arm 227 in a nominal position. As shown in FIG. 3, when a controller, such as the controller 120 of FIG. 1, sends control signals to the pick assembly 224 to pick a sheet of media, the pick arm 224 rotates in the direction 237 (FIG. 3) to engage a top sheet of the stack of media sheets 219 in the tray 225. In FIG. 3, the direction 237 is shown as being clockwise. Further, FIG. 3 illustrates that the tray 232 is in a position 240 such that the tray 232 does not impede the roller 225 from accessing the stack of media sheets 219 in the tray 230. Rotation of the pick arm 227 may be accomplished via a suitable motor and gear assembly (not shown).

After a sheet of the stack of media sheets 219 is picked from the tray 230, the sheet may be advanced along media path 248. The media path 248 passes adjacent the marking engine 222 to permit the marking engine 222 to print on or otherwise image the sheet. The sheet may then be output at media output 251 and may rest against the tray 232 until being removed by a user.

FIG. 4 illustrates the device 200 with the tray 232 in position 242. In FIG. 4, the tray 232 has been moved in direction 271. One or more detents 273 (FIG. 2) may be formed on the housing 213 to position and hold the tray 232 in the position 242. Sheets 275 are positioned on the tray 232. The sheets 275, in some embodiments, may comprise specialty media, such as photo-paper, brochure paper, cardstock, 4×6 inch media, and the like. The tray 232 is configured to receive and hold media of different sizes through the use of guide rails.

FIG. 5 illustrates the pick arm 227 rotated in the direction 237 so that the pick roller 225 engages a top one of the sheets 275 positioned on the tray 232. As shown, therefore, when the tray 232 is in the position 242 (FIGS. 4, 5), the pick roller 225 rotates in the direction 237 to engage media in the tray 232. However, when the tray 232 is in the position 240 (FIGS. 2, 3), the pick roller 225 rotates in the direction 237 to engage media in the tray 230.

Further, similar to the device 100, the device 200 may also be configured to select a print mode based on the position of the tray 232. The device 200 selects a higher-quality print mode when the tray 232 is in the position 242 and a lower-quality, or default print mode when the tray 232 is in the position 240. Selecting a print mode in this manner may result in media 219 being imaged with the default or lower-quality print mode and the media 275 being imaged with a higher-quality print mode. As such, in some embodiments, media in the tray 232 is imaged at a higher-quality print mode than the media in the tray 230. This permits, in some embodiments, selection of a print mode without user interaction with driver software at a host device.

In some embodiments, the tray 232 may be moved manually between positions 240, 242 in a single, gesture-like motion to select print mode, a media type, or both. In other embodiments, the tray 232 may moved under influence of a motor, such as the motor 152 shown in FIG. 1. In an example embodiment, the motor operates in response to user input at an input, such as the input 154 shown in FIG. 1. Optionally, a controller, such as the controller 120, may monitor an amount of time the tray 232 is in the position 240. After expiration of a predetermined period of inactivity for the device 200, the controller 120 may cause the motor to move the tray 232 from the position 240 to the position 242.

Figure 6:
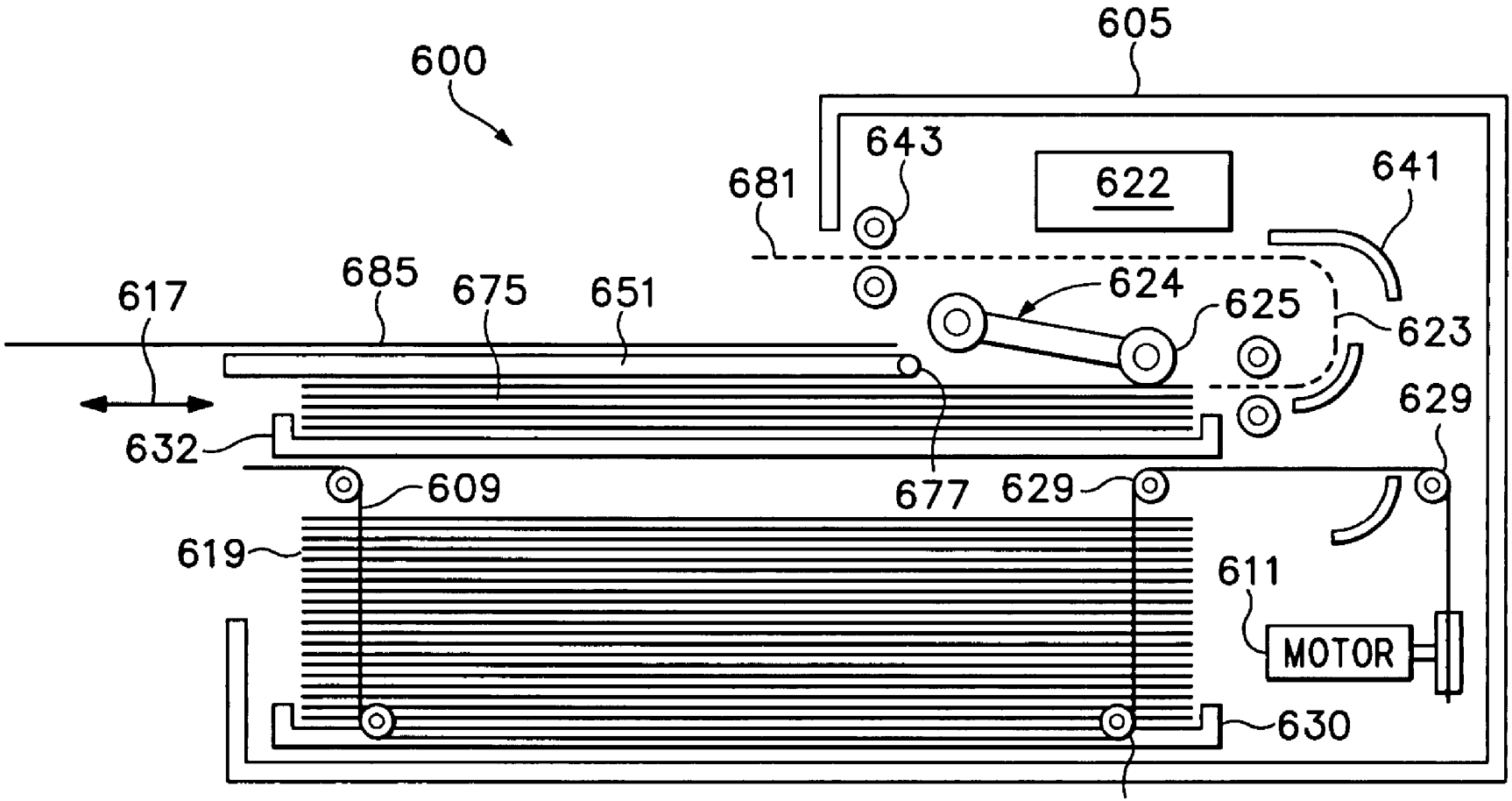
FIG. 6 illustrates an imaging device in accordance with yet another example embodiment.
Figure 7:
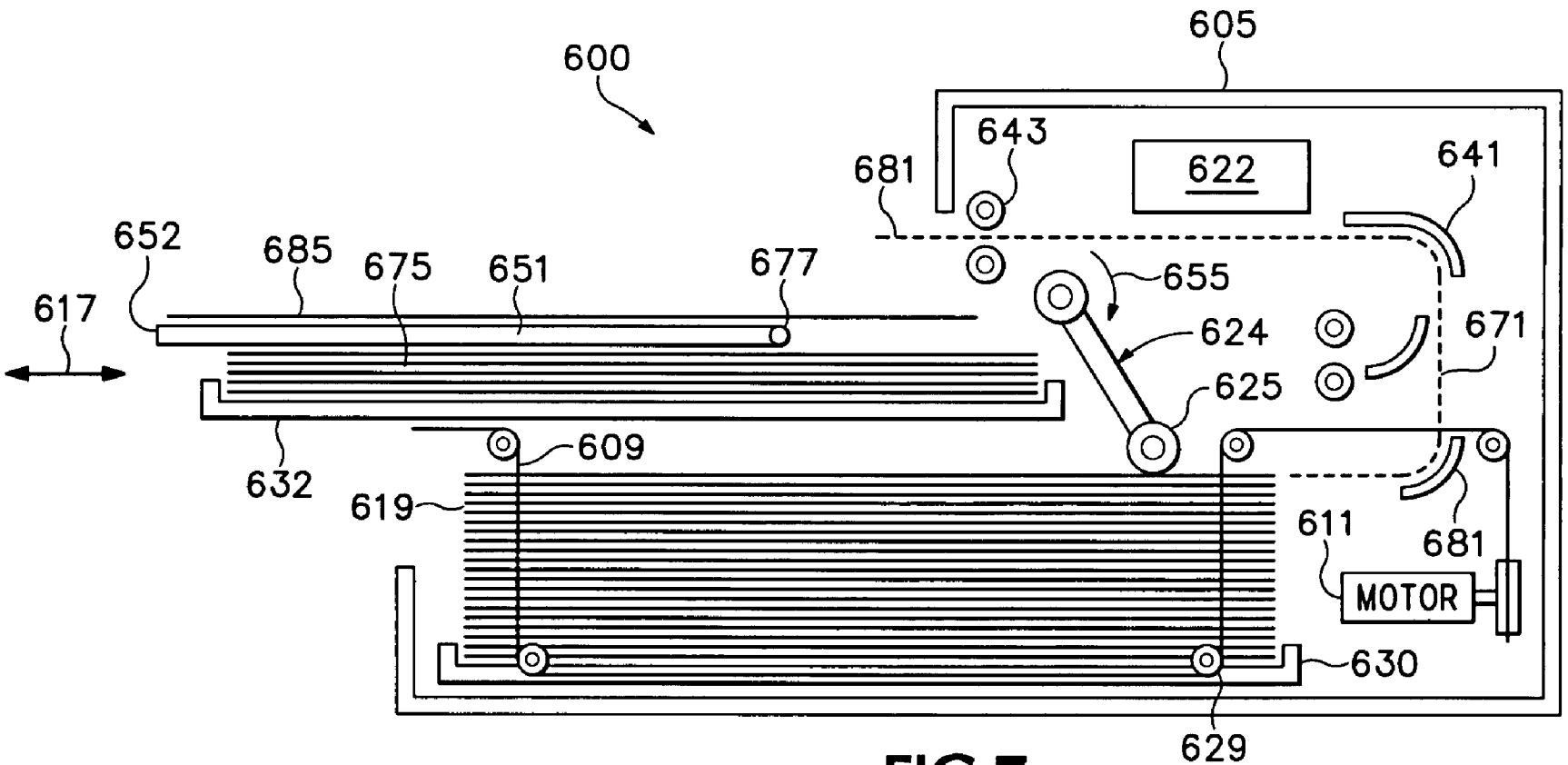
FIG. 7 illustrates the imaging device of FIG. 6 in another position according to another example embodiment.
Figure 8:
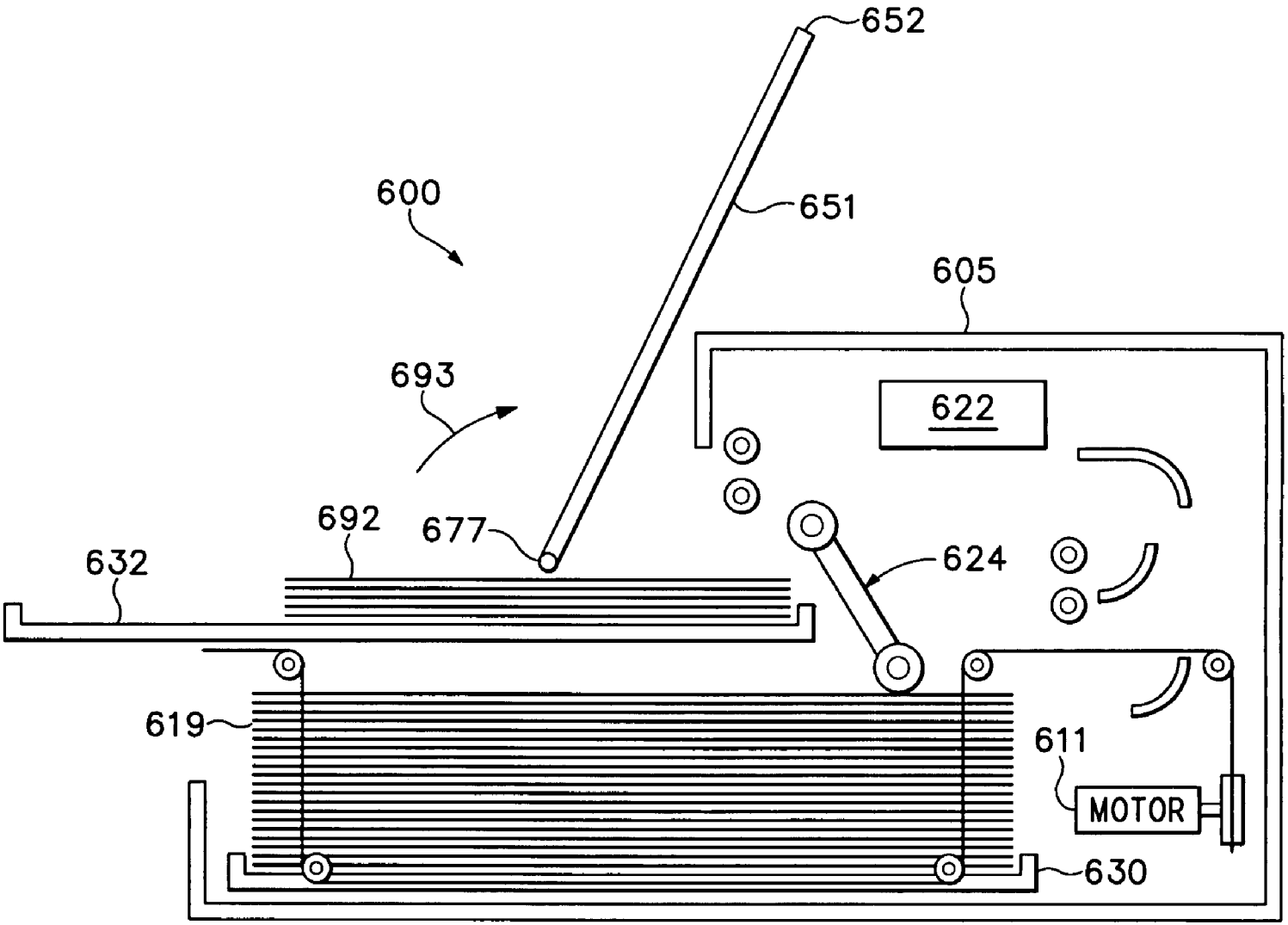
FIG. 8 illustrates the imaging device of FIG. 6 in another position according to another example embodiment.

FIGS. 6-8 illustrate an imaging device 600 in accordance with another example embodiment. With reference to FIG. 6, the imaging device 600 includes media input trays 630 and 632 positioned on or within a housing 605. The tray 632 is configured to move, such as by sliding, in directions 617 relative to the housing 605 and pick mechanism 624 to permit the pick mechanism to selectively pick media from either the tray 630 or 632 depending on the position of the tray 632.

In this embodiment, the tray 630 is configured with an elevator system such that the tray 630 may raise and lower a stack of media sheets 619 relative to a pick mechanism 624. The elevator system may comprise cabling 609 that is coupled to the tray 630 and a motor 611 via one or more pulleys 629. The motor 611 operates under influence of a suitable controller, such as the controller 120 (FIG. 1), to raise and lower the stack of media sheets 619 to permit a top one of the media sheets 619 to be picked by the pick mechanism 624 when the tray 632 is in the position shown in FIG. 7.

Media sheets 675 are positioned on the tray 632 and may be picked by a pick roller 625 of the pick mechanism 624 when the tray 632 is positioned in the position shown in FIG. 6. The pick roller 625 picks a top one of the media sheets 675 and advances the picked one of the media sheets along a media path 623 adjacent a marking engine 622 to an output location. The media path 623 may be defined by one or more guides 641 and/or rollers 643, which guide and/or advance the media along the path 623. As the media passes adjacent the marking engine 622, the marking engine may image the media, such as by applying ink or toner thereto.

An optional cover 651 is positioned on the tray 632. The cover 651 may serve to reduce dust or debris accumulation in the tray 632 and may also serve as an output location for imaged media 685. In some embodiments, the cover 651 is pivotally secured to a side wall of the tray 632 via pivot 677.

In the position shown in FIG. 6, the pick mechanism 624 picks media 675, such as specialty media, directly from the tray 632. With the tray 632 in the position shown in FIG. 6, a tray position sensor, such as the tray position sensor 128 (FIG. 1), detects that the tray 632 is in the position shown in FIG. 6. The position of the tray 632 shown in FIG. 6, in some embodiments, may be referred to as the "stowed" position. A suitable controller, such as the controller 120 (FIG. 1), receives input from the tray position sensor that indicates that the tray 632 is in the position shown in FIG. 6 and, in response, causes the media picked from the tray 632 to be imaged by the marking engine 622 in a high-quality print mode. In some embodiments, the higher quality print mode will include printing at a slower speed and, thus, the media is ejected at a slower speed. The top surface of the cover 651, in some embodiments, is of sufficient size to sufficiently support the media 685 after imaging thereof, allowing cover 651 to effectively function as an output tray or output bin.

FIG. 7 illustrates the device 600 with the tray 632 in an extended position. The tray 632 may be moved from the position of FIG. 6 to the position of FIG. 7 by manually grasping the tray 632 and pulling the tray 632 from the position of FIG. 6 to the position of FIG. 7. In other embodiments, the tray 632 may move from the position of FIG. 6 to the position of FIG. 7 under influence of a motor, solenoid, or spring-actuated mechanical system.

With the tray 632 in the extended position shown in FIG. 7, the pick mechanism 624 may rotate in the direction 655 so that the pick roller 625 contacts a top one of the sheets 619. In the position shown in FIG. 7, the tray 632 is positioned such that the tray 632 does not interfere with the pick mechanism 624 picking from the tray 630. The pick roller 625 may then pick the top one of the sheets 619 and begin advancing the top one of the sheets along path 671, which may be defined by one or more guides 681, 641, and rollers 643. A portion of the path 671 may overlie and be coincident with the path 623. Moving along the along the paths 671, 623 the sheet is at least partially imaged as the sheet passes adjacent the marking engine 622. The sheet is then ejected as sheet 685 onto the cover 651. With the tray 632, and thus the cover 651, in the extended position shown in FIG. 7, the cover 651 is positioned to permit potentially faster moving sheets being ejected from the device 600 to land thereon. This may prevent or reduce media sailing off an end 652 of the tray 651. For slower moving sheets, such as those printed from the sheets 675, the cover 651 in the position shown in FIG. 6 may be sufficient to limit or reduce media sailing of the sheets 675.

Once printing is complete, the motor may retract tray 632 back into its stowed state as shown in FIG. 6, reducing the overall size of the printer back to its compact dimensions. Alternatively, a sensor (not shown) at the output tray may detect when the user removes the printed media and a controller cause the device 600 to retract tray 632 upon detection that the output is removed.

Further, similar to the device 100, the device 600 may also be configured to select a print mode based on the position of the tray 632. One or more tray position sensors, such as the tray position sensor 128 (FIG. 1), in some embodiments, detect that the tray 632 is in the position shown in FIG. 7. A controller, such as the controller 120 then receives a signal from the tray position sensor and causes, either directly or indirectly, the device 600 to print in a lower-quality or default print mode. This default print mode may be one of a plurality of available print modes and may be a print mode that has less than the highest print resolution, a print speed higher than the slowest print speed, or both. Thus, in some embodiments, the sheets 619 on the tray 630 are printed by the device pursuant to a default, or lower-quality, print mode and the sheets 675 on the tray 632 are printed using a different, higher-quality print mode. Conversely, when the tray 632 is in the position shown in FIG. 6, a tray position sensor detects this position. In response to one or more signals from the tray position sensor that the tray 632 is in the position shown in FIG. 6, the controller causes, either directly or indirectly, the device 600 to print in a higher-quality mode than the default or lower quality mode described above.

In some embodiments, the device 600 may include an input mechanism similar to the input 154 shown in FIG. 1. This input mechanism may comprise, for example a toggle button or other suitable input device. A user, by actuating the input mechanism, can cause the tray 632 to move between the positions shown in FIGS. 6 and 7. Alternatively, a user may cause the tray 632 to move the between the positions shown in FIGS. 6 and 7 from a host device, such a PC, by configuring driver software at the host. In this embodiment, the host device transmits tray position data to the device 600 and an controller, such as the controller 120 shown in FIG. 1, causes the tray 632 to move accordingly. As discussed above, in accordance with some embodiments, the device 600 determines a print mode based on the position of the tray 632.

FIG. 8 illustrates the device 600 with the cover 651 in a rotated position. In contrast with the position of FIG. 7, the cover 651 in FIG. 8 has been rotated about pivot 677 in the direction 693. With the cover 651 rotated to the position shown in FIG. 7, a user may be able to readily access media 692, which may comprise specialty media, on the tray 632. Further, with the tray 632 in an extended position shown in FIG. 8 also aids in facilitating access by the user to particularly small embodiments of the media 692, such as 4×6 inch or 3×5 inch media. The cover 651 may be repositioned in the position of FIG. 7 before printing the media 692.

Although the foregoing has been described with reference to example embodiments, workers skilled in the art will recognize that changes may be made in form and detail without departing from the spirit and scope thereof. For example, although different example embodiments may have been described as including one or more features providing one or more benefits, it is contemplated that the described features may be interchanged with one another or alternatively be combined with one another in the described example embodiments or in other alternative embodiments. The subject matter described with reference to the example embodiments and set forth in the following claims is manifestly intended to be as broad as possible. For example, unless specifically otherwise noted, the claims reciting a single particular element also encompass a plurality of such particular elements.

What is claimed is:

1. An imaging device, comprising:

first and second trays, the second tray being movable between first and second positions;

a roller configured to pick media from the first tray when the second tray is in the first position and to pick media from the second tray when the second tray is in the second position; and a print engine configured to print in a first print mode when the second tray is in the first position and print in a second print mode when the second tray is in the second position.

2. The imaging device of claim 1, wherein the first position is at a higher elevation than the second position.

3. The imaging device of claim 1, further comprising one or more detents for maintaining the second tray in at least one of the first and the second positions.

4. The imaging device of claim 1, wherein the second tray comprises a cover configured to cover at least a portion of the first tray.

5. The imaging device of claim 1, wherein the second tray is disposed between the roller and the first tray when the second tray is in the second position.

6. The imaging device of claim 1, wherein the first tray has more capacity than the second tray.

7. The imaging device of claim 1, wherein the first and second trays are parallel to each other.

8. The imaging device of claim 1, wherein the first tray is configured to store 8.5×11 inch or A4 media therein.

9. The imaging device of claim 8, wherein the second tray is adjustable to hold media as large as that capable of being held in the first tray.

10. The imaging device of claim 1, wherein the first and second trays are oriented orthogonal to a direction of gravity.

11. The imaging device of claim 1, wherein the first and second trays are oriented in a range of 0 to 45 degrees from vertical.

12. The imaging device of claim 1, wherein the first and second trays are oriented in a range of 0 to 10 degrees from being horizontal.

13. The imaging device of claim 1, wherein the imaging device is configured to output media on a top surface of the second tray.

14. The imaging device of claim 1, wherein the second tray is configured to move to the second position based on speed of the media exiting the imaging device.

15. An imaging device, comprising:

first and second trays, the second tray being movable between first and second positions; and a roller configured to pick media from the first tray when the second tray is in the first position and to pick media from the second tray when the second tray is in the second position, wherein the imaging device is configured to move the second tray from the second position to the first position after expiration of a predetermined period of inactivity.

16. The imaging device of claim 1, wherein the print engine comprises an inkjet print engine configured to print in the first print mode when the second tray is in the first position and print in the second print mode when the second tray is in the second position.

17. The imaging device of claim 1, wherein the second tray is closer to the roller in the second position than in the first position.

18. The imaging device of claim 1, wherein the second tray has a cover coupled thereto for covering at least a portion of the first tray when the second tray is in the second position.

19. The imaging device of claim 1, wherein the second print mode includes a color print mode.

20. The imaging device of claim 1, wherein the second print mode is a higher quality print mode than the first print mode.

21. The imaging device of claim 1, wherein the second print mode is a higher print resolution mode than the first print mode.

22. An imaging device, comprising:

first and second trays, the second tray being movable between first and second positions;

means for picking media from the first tray when the second tray is in the first position and for picking media from the second tray when the second tray is in the second position; and means for printing in a first print mode when the second tray is in the first position and for printing in a second print mode when the second tray is in the second position.

23. An imaging device, comprising:

first and second trays, the second tray being movable between first and second positions;

a print engine configured to print in different print modes depending on the position of the second tray; and a controller configured to select the different print modes for the print engine based on the position of the second tray.

24. The imaging device of claim 23, wherein one of the different print modes includes a first print resolution and another of the different print modes includes a second print resolution.

25. The imaging device of claim 23, wherein one of the different print modes includes a first media speed and another of the different print modes includes a second media speed.

26. The imaging device of claim 23, wherein one of the different print modes includes color printing and another of the different print modes does not include color printing.

27. An imaging device, comprising:

first and second trays, the second tray being movable between first and second positions;

a pick arm rotatable about a first axis;

a roller rotatable about a second axis and coupled to the pick arm, the roller configured to pick media from the first tray and the second tray, depending upon an angular position of the pick arm; and a print engine configured to print in different print modes depending on the position of the second tray, the print engine configured to print in a default print mode when the second tray is in the first position and print in a higher-quality print mode when the second tray is in the second position.

* * * * *